US009677385B2

(12) United States Patent
Rohde

(10) Patent No.: US 9,677,385 B2
(45) Date of Patent: Jun. 13, 2017

(54) DEVICE AND METHOD FOR REMOVING A MATERIAL WELLING OUT FROM THE SEA BED

(71) Applicant: Uwe Rohde, Steyerberg (DE)

(72) Inventor: Uwe Rohde, Steyerberg (DE)

( * ) Notice: Subject to any disclaimer, the term of this patent is extended or adjusted under 35 U.S.C. 154(b) by 0 days.

(21) Appl. No.: 14/772,080

(22) PCT Filed: Mar. 4, 2014

(86) PCT No.: PCT/EP2014/000546
§ 371 (c)(1),
(2) Date: Sep. 2, 2015

(87) PCT Pub. No.: WO2014/135267
PCT Pub. Date: Sep. 12, 2014

(65) Prior Publication Data

US 2016/0003012 A1 Jan. 7, 2016

(30) Foreign Application Priority Data

Mar. 5, 2013 (DE) ..... 10 2013 003 639

(51) Int. Cl.

| | |
|---|---|
| ***E21B 41/10*** | (2006.01) |
| ***E21B 7/12*** | (2006.01) |
| ***E21B 43/01*** | (2006.01) |
| ***E02B 15/04*** | (2006.01) |
| ***E02B 17/00*** | (2006.01) |

(52) U.S. Cl.
CPC ..... *E21B 43/0122* (2013.01); *E02B 15/04* (2013.01); *E02B 17/0034* (2013.01); *E02B 2017/0095* (2013.01)

(58) Field of Classification Search
None
See application file for complete search history.

(56) References Cited

U.S. PATENT DOCUMENTS 4,568,220 A * 2/1986 Hickey ..... E21B 43/0122 166/338
7,987,903 B1 8/2011 Prado
8,746,344 B2 * 6/2014 Swanson ..... E21B 33/03 166/338

(Continued)

FOREIGN PATENT DOCUMENTS

DE 10 2010 022650 A1 12/2011
DE WO 2011151021 A2 * 12/2011 ..... E21B 36/00

(Continued)

*Primary Examiner* — Matthew R Buck
*Assistant Examiner* — Douglas S Wood
(74) *Attorney, Agent, or Firm* — Whitham, Curtis & Cook, P.C.

(57) ABSTRACT

The invention relates to a device (1) for removing a material (4) welling out from the seabed (2), said device having an outer casing (6) and a tubular guide device (10) that has a longitudinal direction, a later surface and a plurality of segments (12) that can be moved into an open position and a closed position. The lateral surface is closed in the closed position of the segments (12), and therefore the guide device (10) allows a flow of the material (4) only along the longitudinal direction, and the lateral surface has at least one opening in the opening position of the segments (12).

11 Claims, 11 Drawing Sheets

(56) References Cited

U.S. PATENT DOCUMENTS

Figure 1:
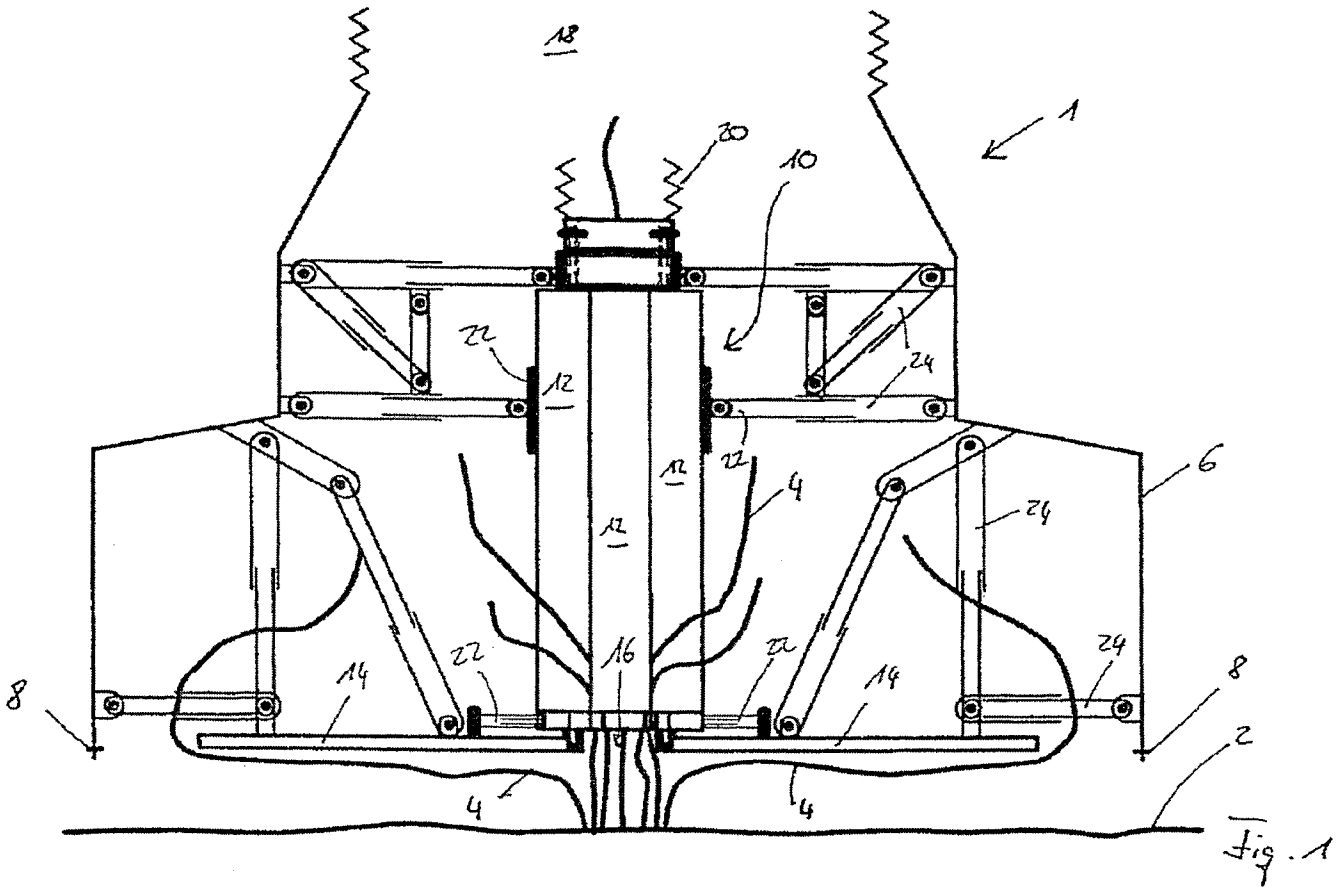

| | | | | |
|---|---|---|---|---|
| 8,789,607 | B2 * | 7/2014 | Jelsma | E21B 43/0122 166/363 |
| 8,887,812 | B2 * | 11/2014 | Caldwell | E21B 43/0122 166/338 |
| 8,910,715 | B2 * | 12/2014 | Linderman | E21B 41/04 166/192 |
| 2015/0337642 | A1 * | 11/2015 | Spacek | E21B 17/003 700/275 |

FOREIGN PATENT DOCUMENTS

| | | | | |
|---|---|---|---|---|
| EP | 0 117 858 | A2 | 9/1984 | |
| EP | 0117858 | A2 * | 9/1984 | E21B 33/037 |
| NL | 2 005 082 | C | 12/2011 | |
| WO | 2011/151051 | A1 | 12/2011 | |

* cited by examiner

A
18
20
22
24
26
28
30
32
34
36
38
40
42
44
46
48
50
52
54
56
58
60
62
64
66
68
70
72
74
76
78
80
82
84
86
88
90
92
94
96

10
12
60
60

10
58
58
12
12
58

10
12
10

54
12
40
40
56

DEVICE AND METHOD FOR REMOVING A MATERIAL WELLING OUT FROM THE SEA BED

The invention relates to a device for removing a material welling out from the seabed. The invention additionally relates to a corresponding method.

A generic device or a generic method can be used, for example, when a gas or, for example, oil emerges from the seabed and has to be removed under control. In particular in the event of defects or accidents in underwater deep-sea bores, it is possible for a raw material which is actually to be conveyed, for example natural oil or gas, to well out from the seabed in an uncontrolled manner. In order to prevent environmental disasters here, it is necessary to seal off the oil or gas leak as quickly, cleanly and safely as possible and, possibly, to remove material welling out. In some cases, however, it may also be expedient to remove under control material welling out from the seabed in a natural way.

Oil and gas fields, which are drilled for the utilization of the raw material, often lie under the seabed nowadays, with the result that the exploitation of such raw material fields has to take place under water and is correspondingly complex, complicated and costly. If, then, for example a gas leak, in which for example natural gas emerges from the seabed in an uncontrolled manner, is to be stopped and sealed off, in addition to the difficulties which arise merely as a result of the fact that an appropriate method has to be carried out under water, the gas normally emerges out of the hole in the seabed under very great pressure and therefore with a high flow velocity. It is thus not simply possible to place an extraction bell, a nozzle or another extraction device on the leak and the emerging material and thus to remove the material under control. The high flow velocity is often additionally increased further by the fact that the emerging gas has a lower density than the surrounding seawater, with the result that here, in addition to the pressure forcing the gas out of the leak, a further uplift arises, which further increases the outlet velocity of the gas.

The invention is thus based on the object of proposing a device and a method for removing a material welling out of the seabed which can be carried out simply, quickly and safely and in addition permits further use of the material that has emerged.

The invention achieves the set object by means of a generic device that has an outer casing and a tubular guide device which has a longitudinal direction, a lateral surface and a plurality of segments which can be moved into an open position and into a closed position, wherein the lateral surface is closed in the closed position of the segments, with the result that the guide device permits a flow of the material only along the longitudinal direction, and wherein the lateral surface has at least one opening in the open position of the segments.

The outer casing of the device is, for example, formed in the shape of a bell and, in order to remove the material welling out of the seabed, is placed with a lower rim on the seabed. The outer casing is placed in such a way that the point of the seabed from which the material wells out is located underneath the outer casing. Consequently, the material welling out of the seabed penetrates into the outer casing of the device from outside and can leave the outer casing upward virtually unimpeded. Placing the device on the material source in the seabed is thus possible in a relatively unproblematic manner, since the high pressure at which the material wells out of the seabed is not transferred to the device or only a relatively small part thereof is transferred.

The device can, for example, have ballast tanks or other ballast containers which, following the placement of the outer casing on the seabed, are filled with a material which has a particularly high density. Conceivable here are, for example, bitumen, concrete or similar materials. This therefore achieves the situation in which the device is held securely on the seabed.

Located in the interior of the outer casing is the tubular guide device, which has a plurality of segments, which are in the open position as the outer casing is placed on the seabed. The tubular guide device also has an opening directed toward the seabed and one directed away from the seabed. Between these two openings there is the lateral surface, which has at least one opening, since the segments are in the open position when placed on the seabed. Consequently, the guide device presents only a relatively low flow resistance to the material welling out of the seabed, with the result that only a relatively low force is exerted on the device and in particular on the guide device by the material welling out of the seabed. This also contributes to the fact that the device can be relatively simply positioned on the seabed.

Optimally, the device is positioned on the seabed in such a way that the opening of the guide device that faces the seabed is arranged exactly above the material source in the seabed. After the device has been fixed securely to the seabed, the segments can be moved from the open position to the closed position. As a result, the lateral surface of the guide device is closed, with the result that no more material which wells out of the seabed can emerge through the lateral surface. Consequently, only a flow of the material through the guide device along the longitudinal direction, that is to say from the opening facing the seabed to the opening facing away from the seabed, is possible. As a result, the flow cross section available to the material is reduced considerably, which results in an increase in the flow resistance and therefore also an increase in the force acting on the device. At the same time, the flow of the material flowing out of the seabed is focused and concentrated and can thus be removed relatively easily.

Advantageously, the device has a bottom surface which has at least one closable opening. In this case, as the device is placed on the seabed, it is therefore placed on the seabed over virtually the entire area. In particular if the point from which the material wells out has a larger diameter than the opening of the guide device that faces the seabed, flow also takes place from the seabed in the area of the bottom surface. In order that the lowest possible flow cross section is opposed thereto by the device, the bottom surface has at least one opening. The flow resistance is reduced if the number of openings is chosen to be as large as possible.

After the device equipped in this way has been placed on the seabed and in particular on the material source and has been fixed to the seabed, the closable openings can be closed simultaneously or one after another. As a result, although the flow resistance and therefore the force acting on the device are increased, the material flowing out of the seabed has to flow along underneath the bottom surface, however, and must thus necessarily enter the guide device through the opening in the guide device that faces the seabed. The segments of the guide device are preferably still located in the open position at this moment, with the result that material flowing into the guide device from below can also leave the guide device through the lateral surface. Then, as already described, the lateral surface of the guide device is closed by the segments being moved from the open position to the closed position.

By using such a device and the method described, it is consequently possible to focus a material welling out of the seabed over a relatively large area and to arrange for the same to flow through a relatively small cross section, with the result that controlled removal becomes possible.

Advantageously, the bottom surface has at least two plates with cutouts arranged to be offset, which can be placed on each other in order to close the openings and, when the openings are opened, are at a distance from each other. This can be achieved, for example, in the form of two parallel plates which have cutouts at different points. If the two plates are at a distance from each other, the material welling out of the seabed is able to flow through the cutout in the first plate and then through the cutout in the second plate that is arranged to be offset thereto and into the outer casing of the device. If the openings in the bottom surface are closed, the two plates are moved toward each other until they rest on each other. At this moment, a flow of the material through the bottom surface is effectively prevented. The material must consequently flow along the side of the bottom surface that faces the seabed until it is able to flow into the opening in the guide device that faces the seabed.

Here, it has proven to be particularly advantageous if the bottom surface has a plurality of bottom segments arranged beside one another, between which there are arranged sealing elements. This means that the bottom surface does not comprise a single element but a plurality of bottom segments, which are in particular arranged on one another in an articulated manner and are provided with sealing elements arranged between them. As a result, it is possible in particular to take account of a seabed that is not quite level without the functioning of the device being impaired. Each of the bottom segments can have at least one closable opening, which can be formed as already described.

In order to be able to anchor the device as securely as possible to the seabed, the device advantageously has at least one anchoring device. This can be formed in the shape of anchors, hooks or large spike-like protrusions, which engage in the seabed. Here, they can be forced into the seabed, for example, by increasing the weight of the device. Of course, other anchoring possibilities are also conceivable. In addition, different anchoring possibilities can be combined with one another. In order in particular to prevent displacement of the device parallel to the seabed following the placement on the seabed, it may be expedient to equip the bottom surface on the underside with studs or protrusions, which engage in the seabed and thus are able to prevent a displacement relative to the seabed.

In an advantageous refinement of the device, the device has at least one shaking device for processing the seabed. This is advantageous in particular for the case in which the seabed is very uneven or particularly loose, in particular at the positions at which the anchoring elements are intended to be fixed to the seabed. By means of the shaking device arranged on the device, the seabed can be processed such that the anchoring elements or another component of the device, for example the outer casing, can be fixed securely to the seabed.

Advantageously, the device has an extraction element, in particular a flexible tube, on which the end of the guide device that faces away from the seabed can be mounted when the segments are in the closed position. Therefore, particularly simple, clean and safe removal of the material welling out from the seabed is made possible.

In a preferred refinement, the outer casing has a diameter which can preferably be adjusted continuously between a minimum value and a maximum value. The device can therefore be used for outlet sources of different sizes of material from the seabed. Within the adjustable range of the diameter of the outer casing, it is thus possible to ensure that the outer housing is placed on the seabed in a contact area which surrounds the outlet source completely. As a result, the flow resistance opposed to the emerging material by the devices during the placement is reduced, and thus the device can be placed more simply on the seabed.

A method according to the invention for removing material welling out from the seabed has the following steps:

a) lowering a device described above onto the seabed, with the result that the outer casing is located over a point of the seabed from which the material wells out, the segments being in the open position,
b) sealing off a contact between the outer casing and the seabed, and
c) moving the segments into the closed position, with the result that the material is removed through the guide device.

In a preferred refinement of the method, the openings in the bottom surface of the device are open as the device is lowered onto the seabed and are closed before the segments are moved into the closed position. The principle on which the invention is based resides in the fact that, as the device is lowered onto the seabed into a position in which the outlet source in the seabed is covered completely by the device, as little flow resistance as possible is opposed to the flowing medium flowing out, and only following the secure fixing of the device on the seabed and following the sealing of the contact between the outer casing and the seabed is the area available to the medium flowing out and through which the medium can flow upward gradually reduced and thus, although the flow resistance is increased step by step, the emerging medium is focused and thus easier removal is ensured.

With the aid of a drawing, an exemplary embodiment of the present invention will be explained in more detail below.

Figure 2:
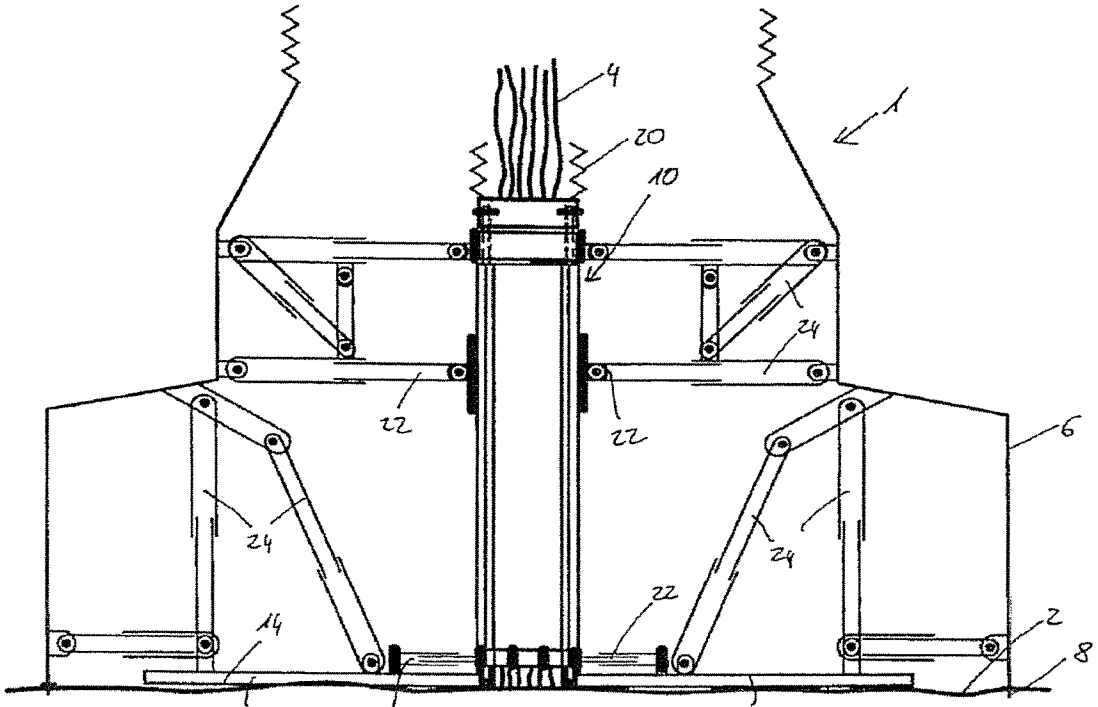
Figure 3:
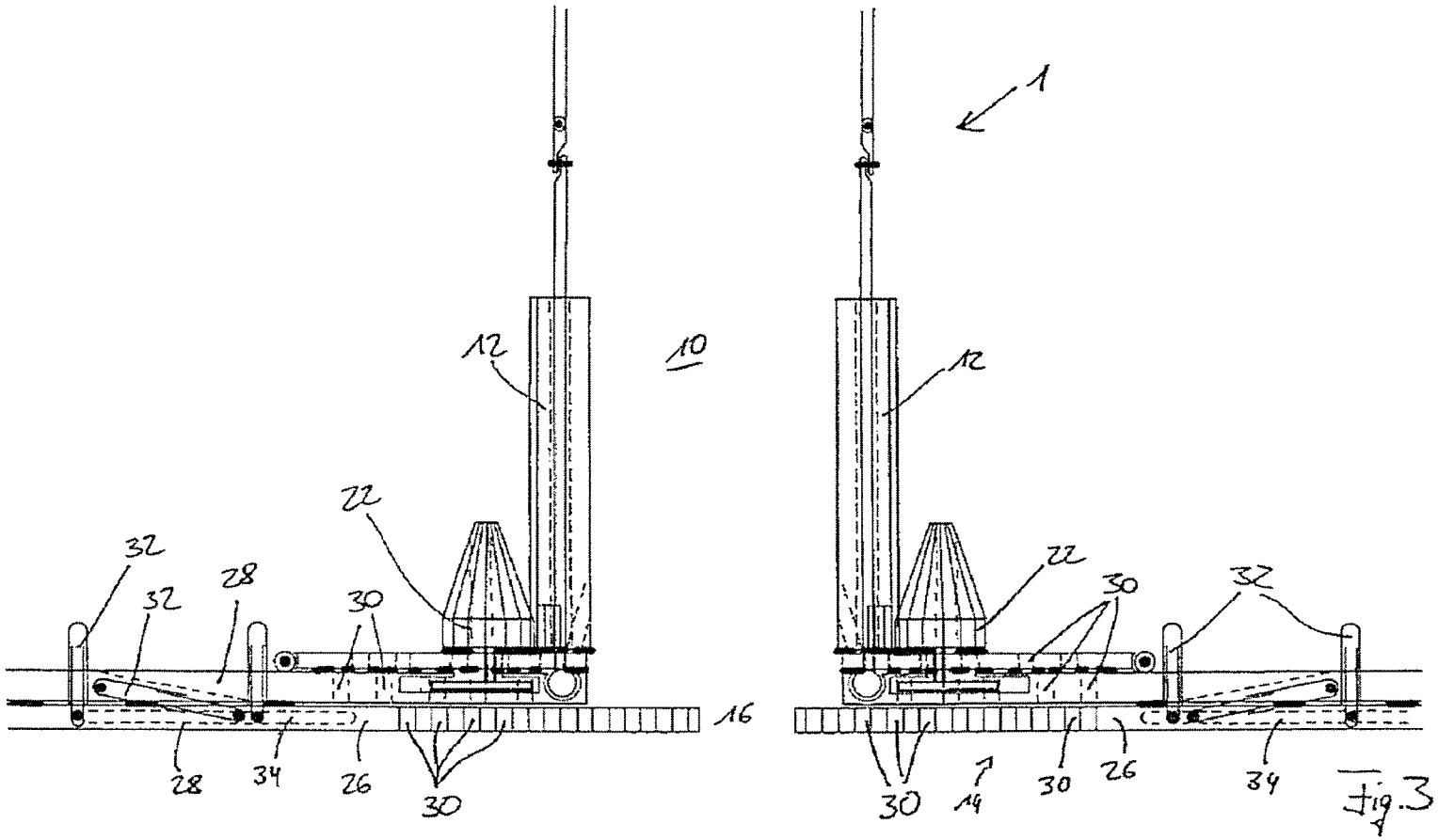
Figure 4:
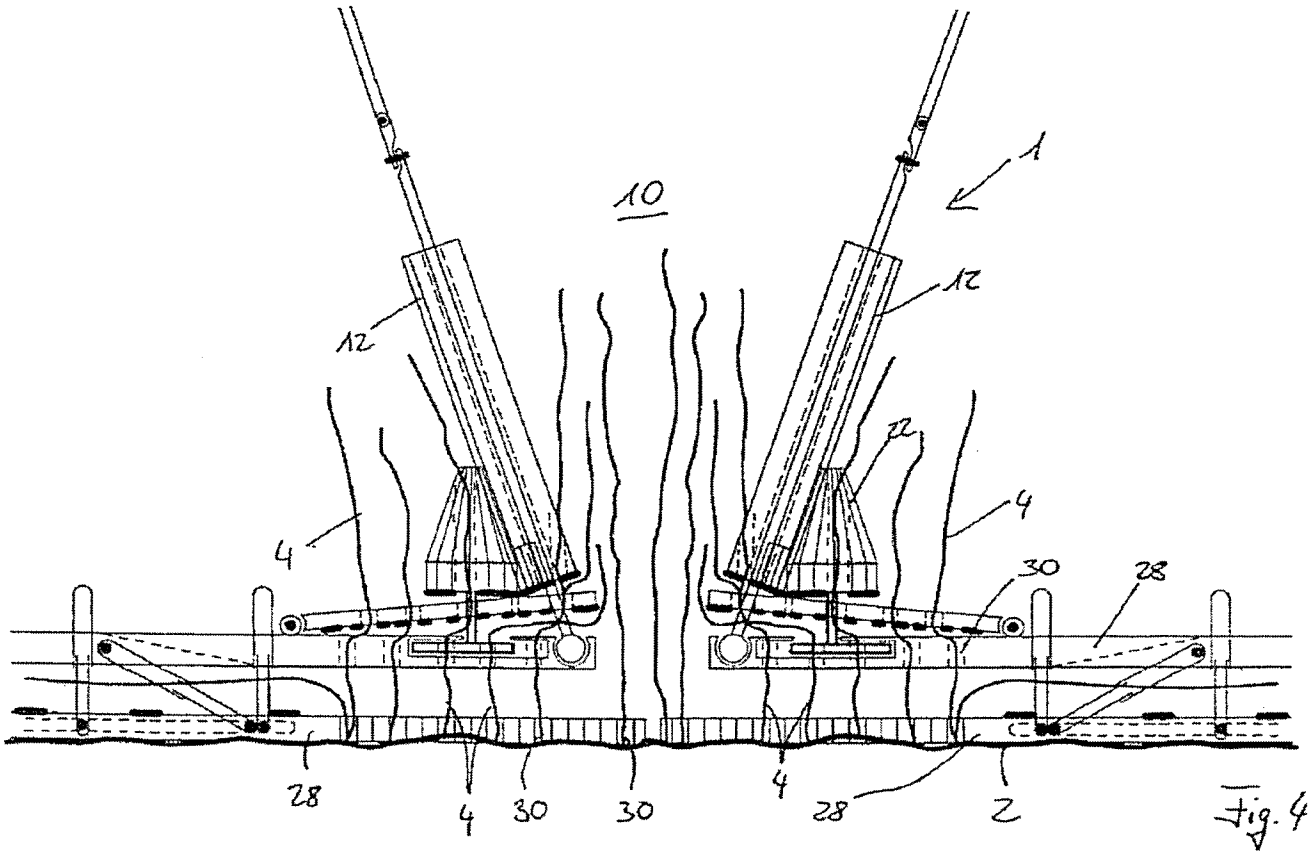
Figure 5:
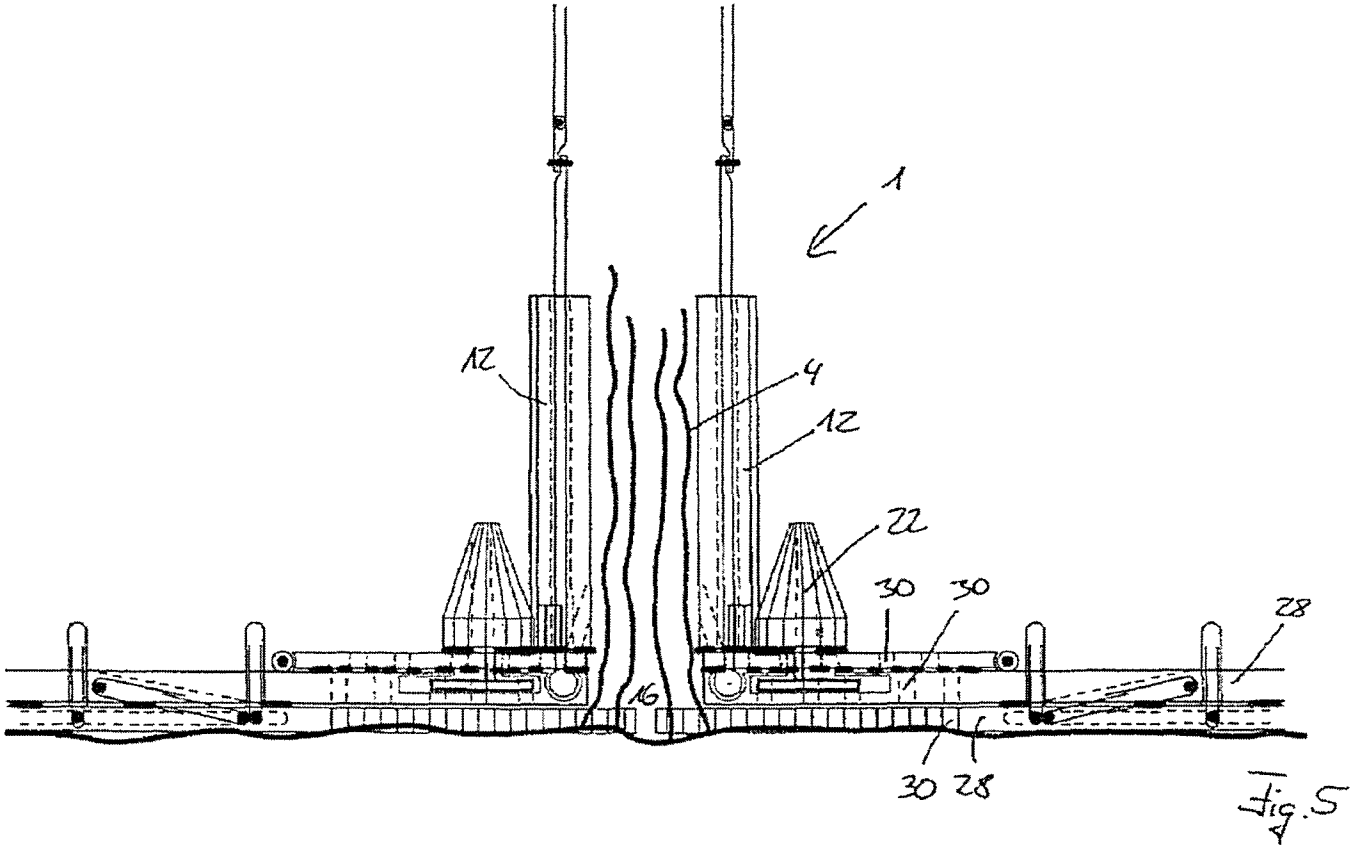
Figure 6:
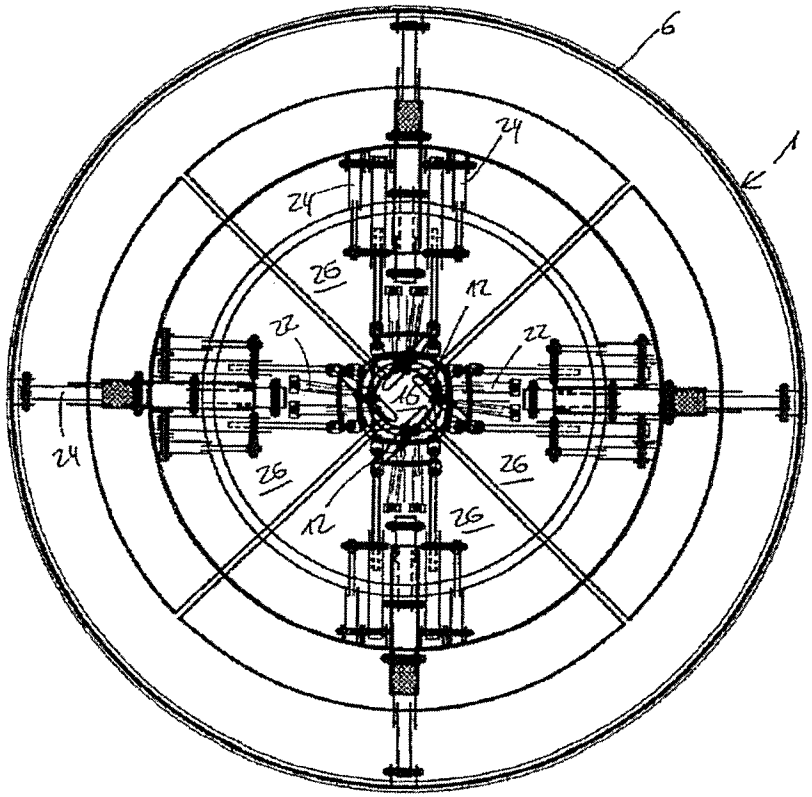
Figure 7:
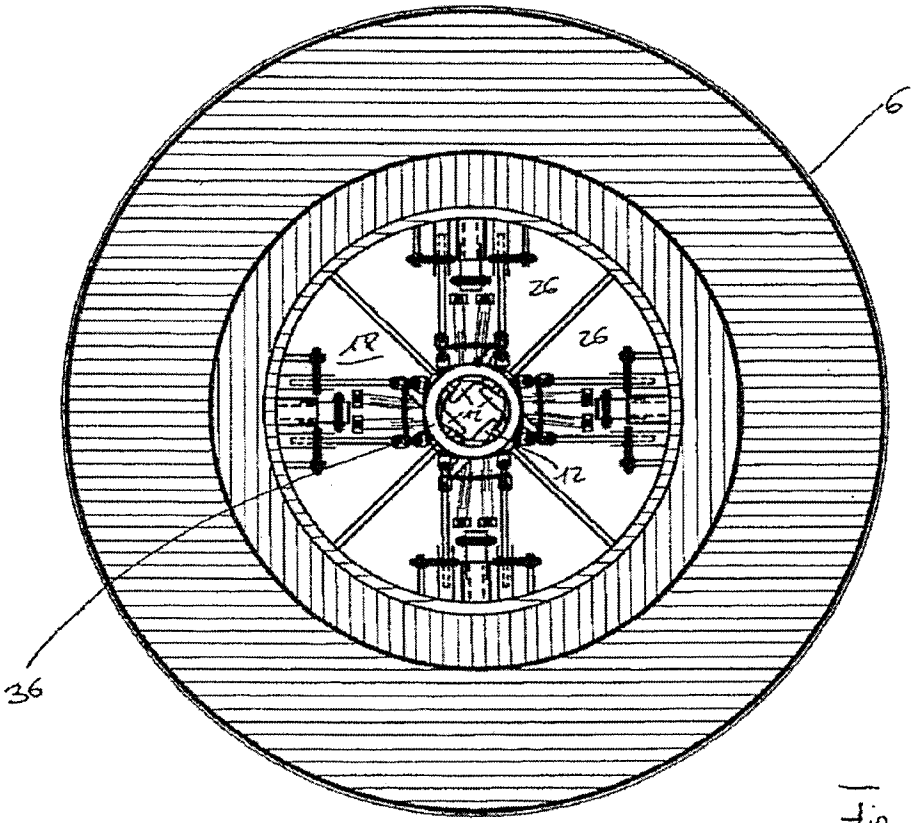
Figure 8:
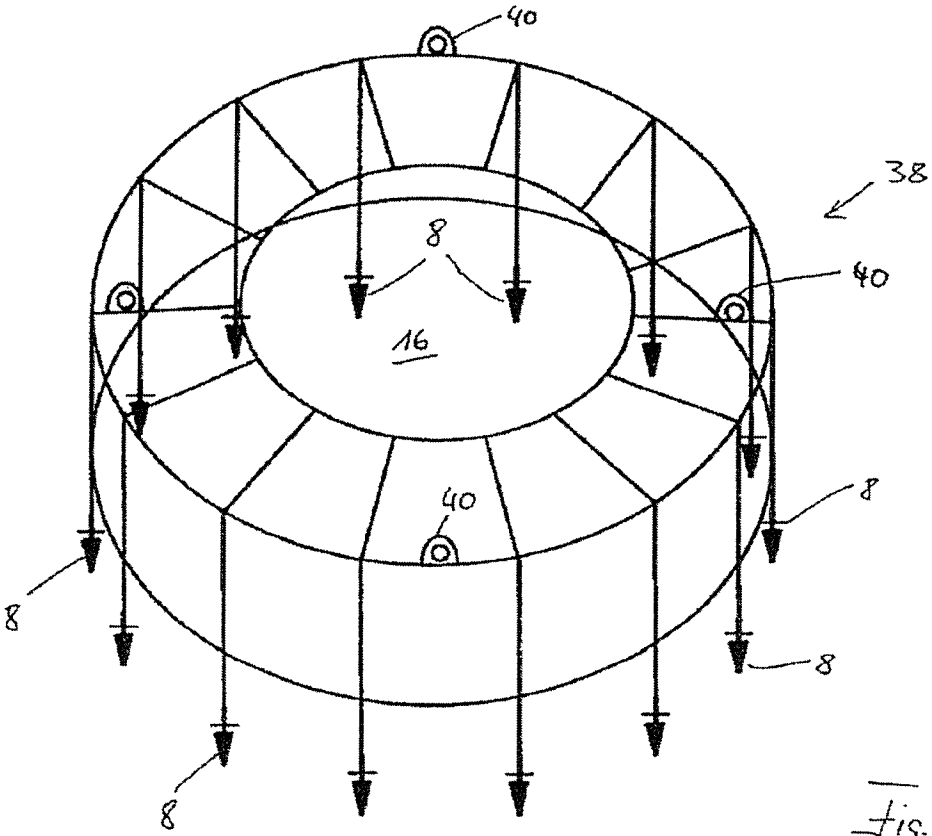
Figure 9:
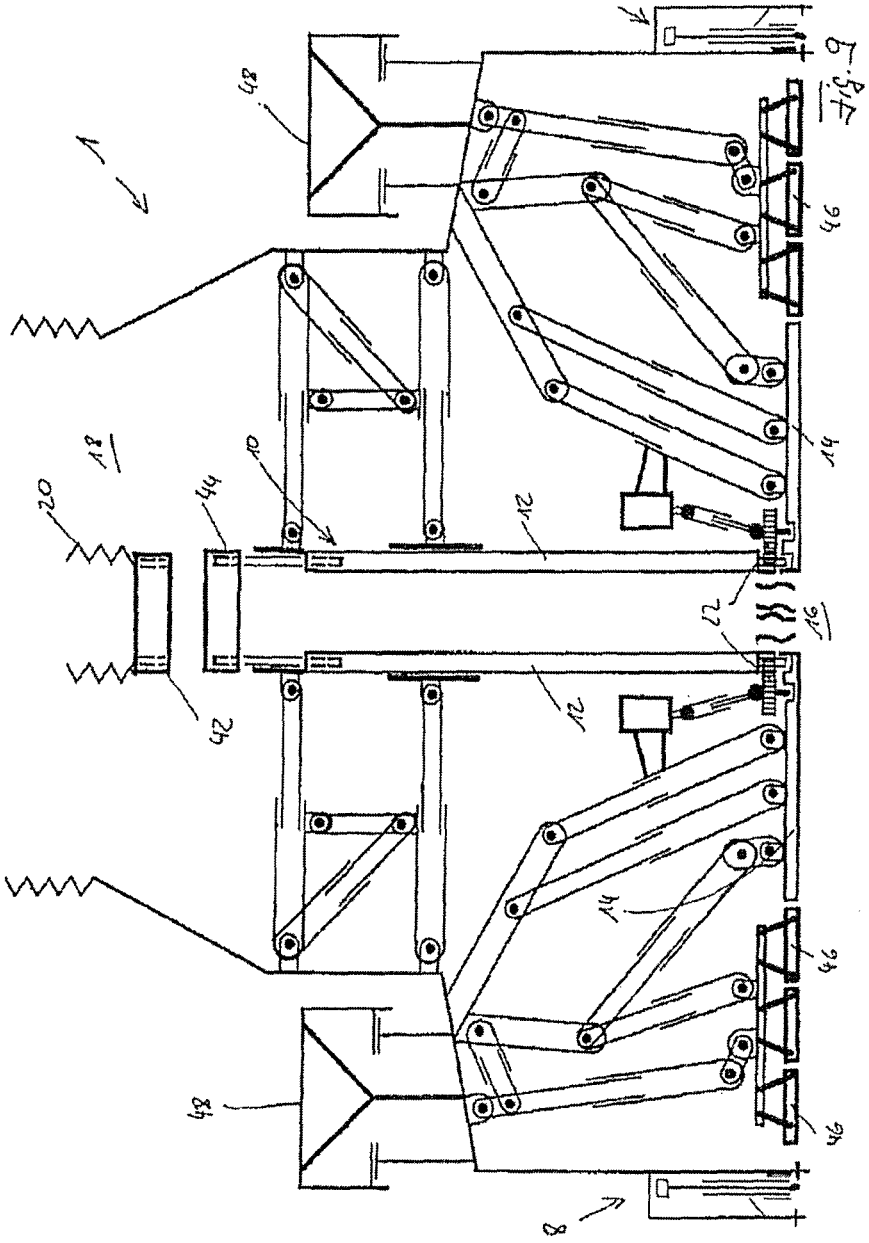
Figure 10:
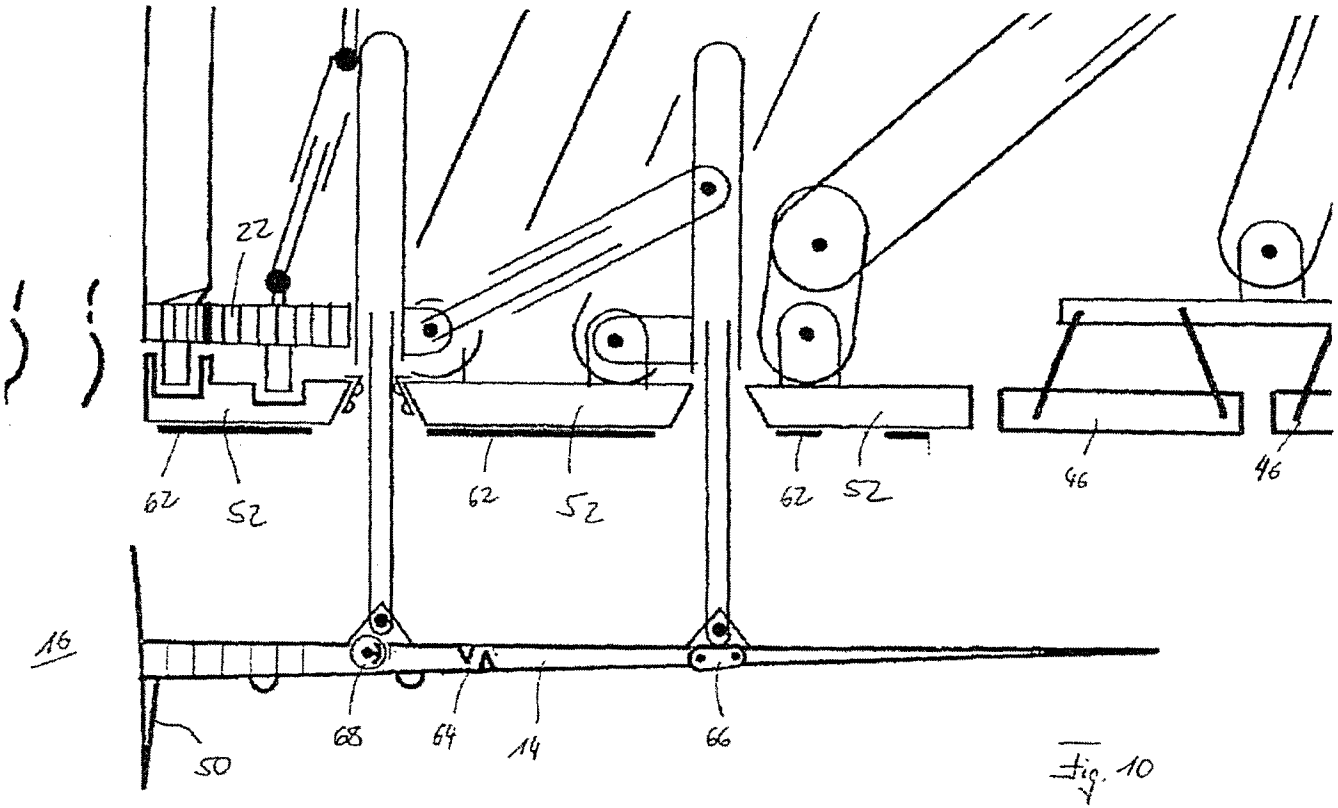
Figures 11, 12A, 12B, 12C:
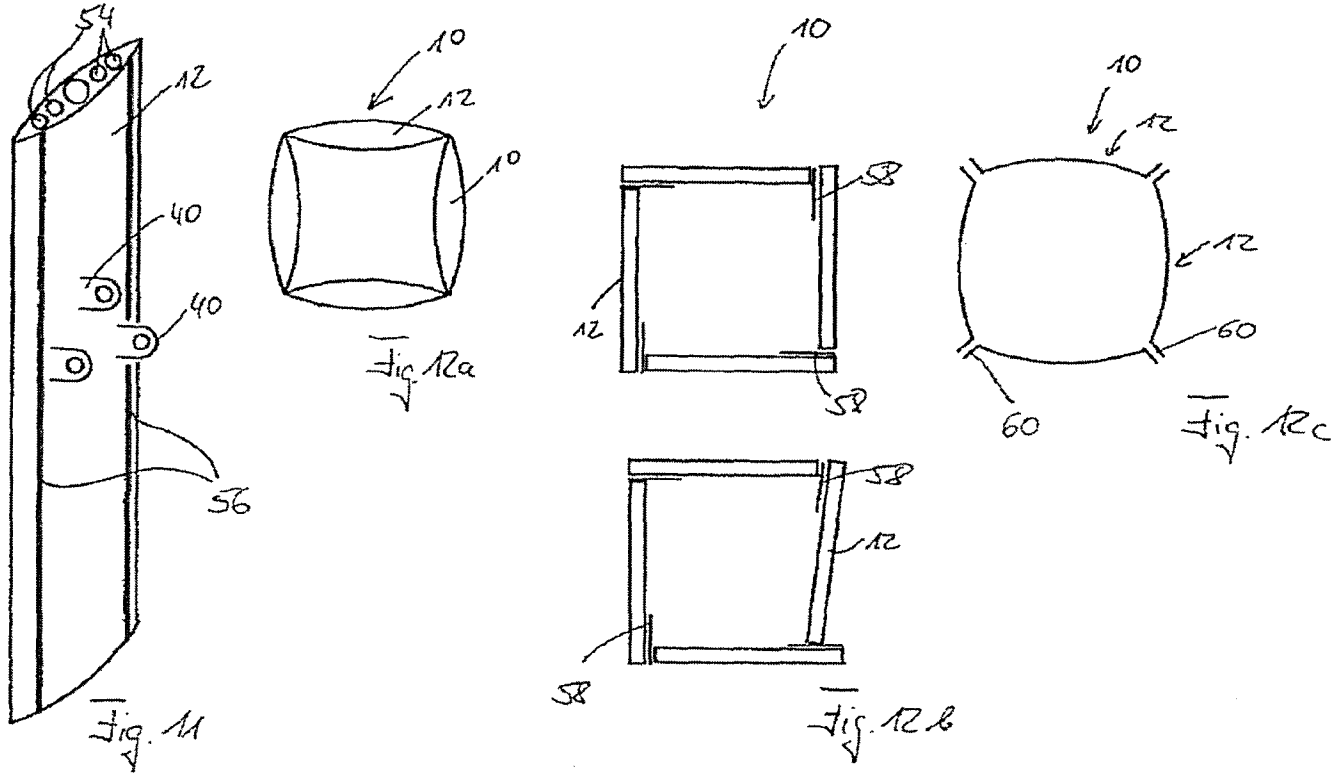

FIG. 1 shows the schematic sectional illustration through a device according to a first exemplary embodiment of the present invention as it is lowered onto the seabed, FIG. 2 shows a schematic sectional illustration through the device from FIG. 1 after the method has been carried out in accordance with a further exemplary embodiment of the present invention, FIG. 3 shows the schematic sectional illustration through a device according to a further exemplary embodiment of the present invention, FIG. 4 shows a schematic sectional illustration through the device from FIG. 3 after the device has been placed on the seabed, FIG. 5 shows the illustration from FIG. 4 after the method has been carried out in accordance with an exemplary embodiment of the present invention, FIG. 6 shows a schematic sectional illustration of a device according to a further exemplary embodiment of the present invention in a plan view, FIG. 7 shows a plan view of the device according to an exemplary embodiment of the present invention, FIG. 8 shows a schematic illustration of a component of a device, FIG. 9 shows a further schematic sectional illustration through a device according to an exemplary embodiment of the present invention, FIG. 10 shows a schematic illustration of a detail from the sectional illustration of a device, FIG. 11 shows the illustration of a segment, and FIGS. 12*a-c* show a sectional illustration through the guide device of a device according to a further exemplary embodiment of the present invention.

FIG. 1 shows a device 1 according to a first exemplary embodiment of the present invention, which is lowered onto a seabed 2. Material 4, which is illustrated in the form of continuous lines in FIG. 1, emerges from the seabed 2.

The device 1 has an outer casing 6, on the underside of which there is an anchoring device 8. In the exemplary embodiment shown in FIG. 1, said anchoring device 8 is forced into the seabed 2 and thus locks the device 1 to the seabed 2.

Within the outer casing 6 there is a guide device 10, the longitudinal direction of which extends from top to bottom in the exemplary embodiment shown in FIG. 1. It can be seen that the guide device 10 has a plurality of segments 12 which, in the state shown in FIG. 1, are in an open position. Material 4 passes out of the guide device 10 through a lateral surface of the guide device 10 which, in the present example, is formed by the segments 12.

On the underside of the device 1 there is a bottom surface 14, which is intended to be placed on the seabed 2. Located in the center is an inlet opening 16, through which the material 4 can penetrate into the guide device 10. In the state shown in FIG. 1, part of the material 4 flows past the bottom surface 14 on the outside and penetrates into the outer casing 6. All of the material penetrating into the outer casing 6 can leave the device 1 upward through an outlet opening 18. It would also be possible for a large extraction nozzle or another removal device for material 4 emerging at this point to be arranged at this point.

On the side of the guide device 10 that faces away from the seabed 2 there is an extraction element 20, by which the material which flows through the guide device 10 is removed. The individual segments 12 can be moved from the open position shown in FIG. 1 to the closed position via actuating elements 22, of which respectively two are shown for the right-hand and left-hand segment 12.

FIG. 2 shows the device 1 from FIG. 1 after it has been placed on the seabed 2 and the method according to an exemplary embodiment of the present invention has been carried out. It can be seen that the anchoring devices 8 have been forced into the seabed 2 and thus effect locking of the device 1 to the seabed 2. The material 4 which flows out of the seabed 2 can penetrate only through the inlet opening 16 into the outer casing 6 and therefore into the device 1. In the state shown in FIG. 2, the segments 12 are in the closed position, with the result that no material 4 can emerge through the lateral surface of the guide device 10. It can additionally be seen that all of the material 4 which passes through the inlet opening 16 into the guide device 10 leaves the latter at the top and is removed by the extraction element 22. The bottom surface 14 rests on the seabed 2 and thus leads to sealing, with the result that the lateral entry of material 4 into the outer casing 6 is prevented.

Both FIG. 1 and FIG. 2 illustrate a plurality of adjustable-length supporting elements 24, which have different tasks. Some of the supporting elements 24 are connected to the respective bottom surface 14. It can be seen that the bottom surface 14 comprises at least two bottom segments 26, which are each connected to at least two supporting elements 24. In this way, account can be taken of an uneven seabed 2. Thus, it is for example possible to raise, lower or incline the individual bottom segments 26 slightly, if appropriate even separately from one another, in order, even when the outer casing 6 has been placed on the seabed 2, to achieve optimal adaptation to an uneven seabed 2. Other supporting elements 24 and, in particular, also the actuating element 22 are likewise designed to have adjustable lengths, in order to be able to change the diameter of the outer casing 6. Therefore, it is possible to take into account different diameters of outlet sources through which material 4 emerges from the seabed 2.

FIG. 3 shows the schematic sectional illustration through a device 1 according to a further exemplary embodiment of the present invention. Here, too, in the lower region there is the bottom surface 14 which once more has at least two bottom segments 26 shown. Between the bottom segments 26 there is the inlet opening 16, above which the guide device 10 adjoins. The actuating elements 22, with which the segments 12 of the guide device 10 can be moved from the open position to the closed position and vice versa, are formed as bevel gears in the present example. It can be seen that the bottom segments 26 comprise two plates 28 which are respectively arranged above one another and which have cutouts 30 at different positions, through which the material 4 from the seabed 2, which is not illustrated in FIG. 3, can flow. Via actuating elements 32, the plates 28 respectively lying above one another can be spaced apart from one another or laid over one another. The fact that one end of the actuating elements 32 runs in slots 34 provided for the purpose means that the respective upper plate 28 can additionally be displaced relative to the respective lower plate 28, which also results in a displacement of the guide device 10 relative to the inlet opening 16. Therefore, following the placement of the device 1 on the seabed 2, the actual position of the guide device 10 can be adjusted retroactively.

FIG. 4 shows the device 1 according to FIG. 3 following the placement on the seabed 2. It can be seen firstly that, as compared with FIGS. 1 and 2, the material 4 emerges from the seabed 2 over a large area. All of the area of the respective lower plates 28 lies on the seabed 2 but, as a result of the cutouts 30 that are provided, permit the material 4 to pass through these cutouts 30 and, since the two plates 28 lying one above another are each arranged at a distance from one another, said material 4 also passes through cutouts 30 in the respective upper plate 28. The openings in the bottom surface 14 are thus open.

However, part of the material 4 also passes through the guide device 10 which, in the state shown, is designed to be widened, since the individual segments 12 are each tilted toward the outside. In the process, the conical surface of the individual bevel gears which function as actuating elements 22 come into contact with rows of teeth provided for the purpose on the outside of the segments 12.

FIG. 5 shows the situation after the method according to an exemplary embodiment of the present invention has been carried out. The plates 28 of the bottom surface 14 which are respectively arranged above one another now rest on one another and thus, as a result of the offset arrangement of cutouts 30, prevent material 4 from the seabed 2 from being able to penetrate into the device 1 at these points. This is possible only through the inlet opening 16 or cutouts 30 arranged in this area. The openings in the bottom surface 14 are thus closed. The material 4 enters the guide device 10 in this area. The individual segments 12 in the exemplary embodiment shown have been tilted into the vertical position again and moved into the closed position, for which purpose the actuating elements 22 have been used.

FIG. 6 shows a schematic sectional illustration in a plane parallel to the seabed 2. It is possible to see four bottom segments 26 shaped like a quarter-circle. In the middle there is the inlet opening 16, which is surrounded by four segments 12. The latter can be moved from the closed to the open position and vice versa by the actuating elements 22.

The outermost ring is formed by the outer casing 6, which is connected to the remaining components via different supporting elements 24. Here, too, the supporting elements 24 are designed to be longitudinally displaceable, in order thus to be able to change the diameter of the outer casing 6.

FIG. 7 shows the illustration from FIG. 6 but not in a sectional illustration but in a plan view. The outer casing 6 bounds the device on the outside. In the center, the four bottom segments 26 and the segments 12 can be seen. As in FIG. 6, the segments 12 are in the open position, with the result that the guide device 10 does not have a closed lateral surface. Nevertheless, at the end of the guide device 10 that faces away from the seabed bed, an arrangement device 36, on which an extraction element 20, for example a flexible tube, can be arranged, is illustrated. This is visible through the outlet opening 18, which can be seen easily in FIG. 7.

FIG. 8 shows the schematic illustration of a holding frame 38, in which the inlet opening 16 is located. Located around the circumference of the holding frame are anchoring devices 8, with which the holding frame 38 can be anchored to the seabed 2. Arranged at the upper end of the holding frame 38 are transport eyes 40, to which, for example, hook elements—not illustrated—can be fixed, with the result that the holding frame 38 can be placed and positioned on the seabed in a controlled way. Further components, in particular the segments 12, can be fixed to the holding frame 38. In this way, particularly good anchoring of the modules and components fixed to the holding frame 38 is ensured.

FIG. 9 shows a further sectional illustration through a device 1 according to a further exemplary embodiment of the present invention. However, it has some differences from the device illustrated in FIG. 1, for example, which will be discussed separately. Within the outlet opening 18 there is the extraction element 20, which has a first contact element 42 at its lower end. Said contact element 42 can be connected to a second contact element 44, which is arranged above the guide device 10. In the exemplary embodiment shown in FIG. 9, the two contact elements 42, 44 are not yet connected to each other.

The guide device itself again comprises a plurality of segments 12, which can be moved from a closed to an open position and vice versa by actuating elements 22.

The bottom surface 14 is formed as a large-area element in the area around the inlet opening 16. In the edge region, however, the device has plate elements 46, between which there are located openings, with the result that adequate strength and stability of the device 1 on the seabed 2 is ensured and, at the same time, the material flowing out of the seabed 2, which is not illustrated in FIG. 9, can penetrate into the device 1 at a plurality of different positions.

Additionally arranged in the outer edge regions of the device are anchoring devices 8, which ensure further stabilization of the device on the seabed 2.

The device illustrated in FIG. 9 additionally has buoyancy tanks 48, which can be filled with air or water and thus regulate the buoyancy of the device 1. It is therefore possible to ensure that the device 1 just sinks onto the seabed 2 and, by blowing in further air, the re-surfacing of the device 2 after work has been done is also initiated.

FIG. 10 shows a schematic illustration of a detail from a device 1. It is possible to see the bottom surface 14, which has a fixing spike 50 at a radial inner end. Above the actual bottom surface 14 there are weighting elements 52, by means of which a pressure can be exerted on the bottom surface and the latter can thus be forced into the seabed. In addition, the actuating elements 22, the inlet opening 16 and two plate elements 46 are indicated.

Arranged on the underside of the weighting elements 52 is a sealing compound 62. This has already been illustrated in FIGS. 3, 4 and 5 in the form of a thick line and has a consistency which enables it to penetrate into any cavities that may be present. As a result, not only is sealing of the corresponding cavities ensured but the cavities are filled, with the result that, for example, no gas flowing in from below can collect in the cavities. This would result in an increased uplift on the device, which would make secure holding of the device on the seabed more difficult.

The bottom surface 14 in FIG. 10 has a plurality of devices and precautions in order to permit the best possible adaptation and arrangement on the seabed. Thus, a reduction in cross section 64 can be provided at different points of the bottom surface 14. In this way, the elasticity of the bottom surface 14 which, for example, consists of a metal, is increased at this point, with the result that the bottom surface 14 can if necessary follow existing irregularities in the seabed better. For the same reason, also illustrated by way of example in FIG. 10 is a joint 6, by which means the proportions of the bottom surface 14 which are located on the right and left of the joint 66 can move relative to each other, with the result that optimal adaptation to the seabed is achieved here.

In addition, arranged in the bottom surface 14 is a shaking device 68, which is implemented by means of a rotatable unbalanced mass. As a result, it is firstly possible to move the fixing spike 50 and further fixing elements that may possibly be present into the seabed and, at the same time, to compact the seabed located under the bottom surface.

FIG. 11 shows a segment 12 such as is used for a guide device 10 of a device 1 according to an exemplary embodiment of the present invention. In the interior of the segments 12 there extend bores 64, which firstly reduce the weight of the segments 12 and secondly can be used as a heating or cooling conduit, for example. In addition, in the surface of the segments 12 there extend guide rails 56, into which tools, not illustrated, can be moved in order for example to lock said tools in the necessary position. Also arranged on the segments 12 are transport eyes 40, which are used firstly to transport the segments 12 and secondly can also be used as a point of action for actuating elements 22.

FIGS. 12*a* to 12*c* show, in a sectional illustration, different cross sections of guide devices 10 which each comprise four segments 12 in the exemplary embodiment shown. Here, the individual segments can be rotated, for example about a pivot axis which extends at right angles to the drawing plane, and can thus be moved from an open to a closed position and vice versa. In particular in the variant which is illustrated in FIG. 12*b*, in which the guide device 10 comprises four plate-like segments 12, sealing elements 58 are illustrated between the individual segments 12, ensuring that the guide device 10 is leak-proof in the closed state, with the result that no material 4 which flows out of the seabed 2 can leave the guide device 10 in an undesired direction.

In particular in the lower illustration of FIG. 12*b*, one advantage of this embodiment becomes clear. If, for example because of external action of force or as a result of other needs, such as the specific shape of the seabed or because of other reasons, the individual segments 12 are not arranged in their optimal position, which is illustrated in the upper part in FIG. 12*b*, the sealing elements 58 nevertheless ensure a leak-proof connection and ensure the functionality of the device.

FIG. 12*c* shows a further possible way of combining four segments 12 to form a guide device 10, wherein a sealing surface 60 is provided between each two adjacent segments 12.

| List of reference signs | |
|---|---|
| 1 | Device |
| 2 | Seabed |
| 4 | Material |
| 6 | Outer casing |
| 8 | Anchoring device |
| 10 | Guide device |
| 12 | Segment |
| 14 | Bottom surface |
| 16 | Inlet opening |
| 18 | Outlet opening |
| 20 | Extraction element |
| 22 | Actuating element |
| 24 | Supporting element |
| 26 | Bottom segment |
| 28 | Plate |
| 30 | Cutout |
| 32 | Actuating element |
| 34 | Slot |
| 36 | Arrangement device |
| 38 | Holding frame |
| 40 | Transport eye |
| 42 | First contact element |
| 44 | Second contact element |
| 46 | Plate element |
| 48 | Buoyancy tank |
| 50 | Fixing spike |
| 52 | Weighting element |
| 54 | Bore |
| 56 | Guide rail |
| 58 | Sealing element |
| 60 | Sealing surface |
| 62 | Sealing compound |
| 64 | Cross-sectional cleaning |
| 66 | Joint |
| 68 | Shaking device |

The invention claimed is:

1. A device for removing a material welling out of the seabed, comprising:

an outer casing;

a tubular guide device within the outer casing which has a longitudinal direction, a lateral surface, and a plurality of segments which can be moved or pivoted radially, in a direction different from the longitudinal direction, into an open position and into a closed position, wherein the lateral surface is closed in the closed position of the segments, with the result that the guide device permits a flow of the material only along the longitudinal direction, and wherein the lateral surface has at least one opening in the open position of the segments.

2. The device as claimed in claim 1, further comprising a bottom surface with at least one closable opening.

3. The device as claimed in claim 2, wherein the bottom surface has at least two plates with cutouts arranged to be offset, wherein the at least two plates can be placed on each other in order to close the openings and, when the openings are opened, are at a distance from each other.

4. The device as claimed in claim 2, wherein the bottom surface has a plurality of bottom segments arranged beside one another, between which there are arranged sealing elements.

5. The device as claimed in claim 1, further comprising at least one anchoring device for anchoring the device to the seabed.

6. The device as claimed in claim 1, further comprising at least one shaking device for processing the seabed.

7. The device as claimed in claim 1, further comprising an extraction element which is mountable at an end of the tubular guide device that faces away from the seabed when the segments are in the closed position.

8. The device as claimed in claim 1, wherein the outer casing has a diameter which can be adjusted continuously between a minimum value and a maximum value.

9. A method for removing a material welling out of the seabed, comprising the following steps:

a) lowering a device as claimed in claim 1 onto the seabed, with the result that the outer casing is located over a point of the seabed from which the material wells out, the segments being in the open position, b) sealing off a contact between the outer casing and the seabed, and c) moving the segments into the closed position, with the result that the material is removed through the guide device.

10. The method as claimed in claim 9, wherein the openings in the bottom surface of the device are open as the device is lowered onto the seabed and are closed before the segments are moved into the closed position.

11. The device as claimed in claim 7 wherein the extraction element is a flexible tube.

* * * * *